United States Patent [19]

Seipel

[11] 3,998,137

[45] Dec. 21, 1976

[54] ENVELOPE MAKING MACHINE

[75] Inventor: Hans J. Seipel, Boardman, Ohio

[73] Assignee: American Paper Products Company, Youngstown, Ohio

[22] Filed: May 5, 1975

[21] Appl. No.: 574,516

[52] U.S. Cl. ..... 93/61 R; 93/62

[51] Int. Cl.[2] ..... B31B 1/26

[58] Field of Search ..... 93/62, 61 R, 61 A, 63 R, 93/63 M, 84 R, 84 FF

[56] References Cited

UNITED STATES PATENTS

| | | | |
|---|---|---|---|
| 2,612,088 | 9/1952 | Heywood | 93/62 |
| 3,079,847 | 3/1963 | Polidori, Jr. | 93/62 |
| 3,643,555 | 2/1972 | Ehlscheid | 93/62 |
| 3,668,982 | 6/1972 | Stemmler | 93/62 |

*Primary Examiner*—James F. Coan

*Attorney, Agent, or Firm*—Brown, Murray, Flick & Peckham

[57] ABSTRACT

A first roll is provided in its periphery with a row of vacuum holes extending lengthwise thereof for holding against it the previously folded leading edge of a traveling envelope having an unfolded closing flap at the trailing edge of the side of the envelope remote from the roll. The roll carries the envelope between it and a second roll rotating in the opposite direction and also provided with a row of vacuum holes to hold the closing flap against it so that the envelope will be pulled away from the first roll and the flap will be folded behind the adjoining portion of the envelope. After the envelope has been pressed against the second roll to crease the fold at the flap, the envelope is removed from the second roll.

3 Claims, 19 Drawing Figures

Fig. 17
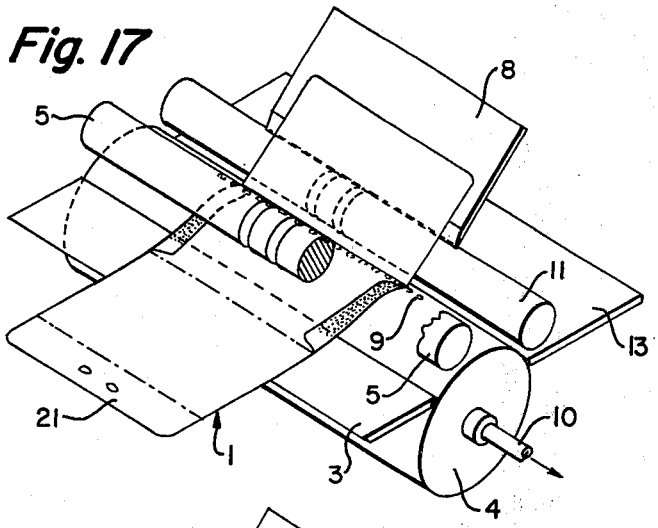
Fig. 1
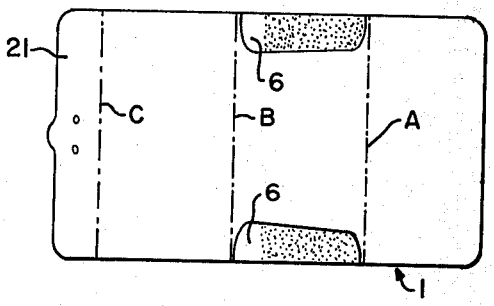
Fig. 2
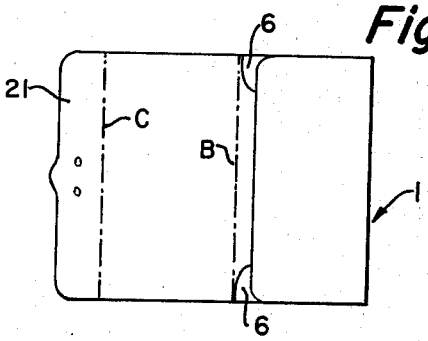
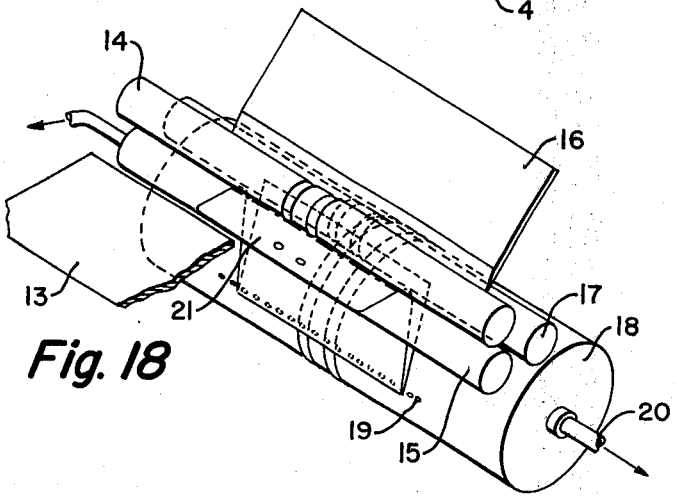
Fig. 18
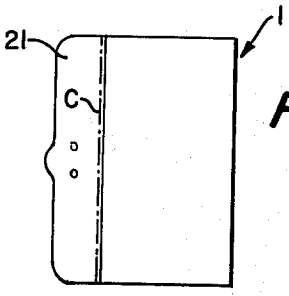
Fig. 3
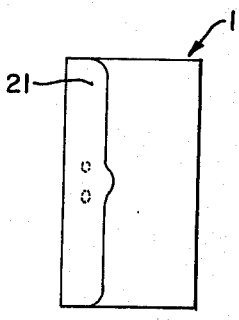
Fig. 4
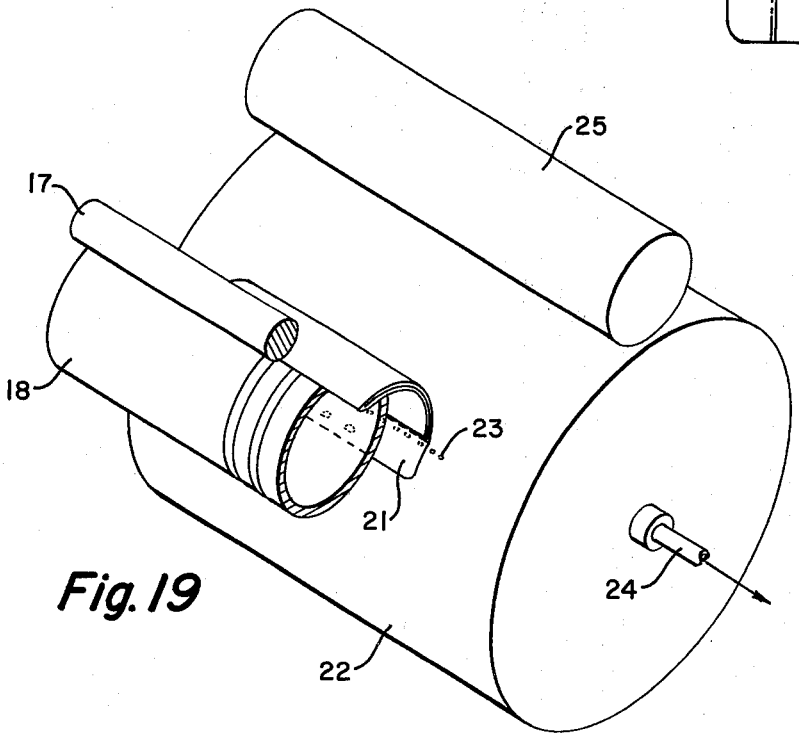
Fig. 19

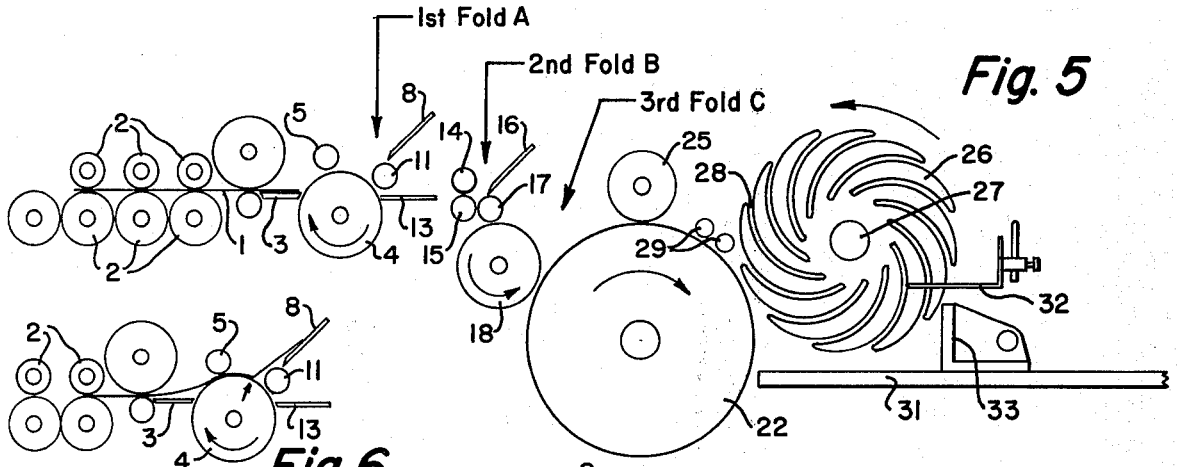
Fig. 5
Fig. 6
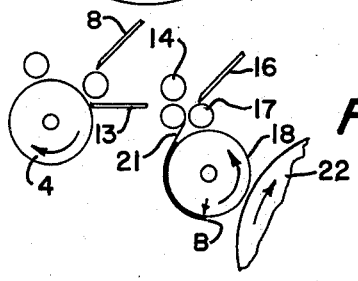
Fig. 12
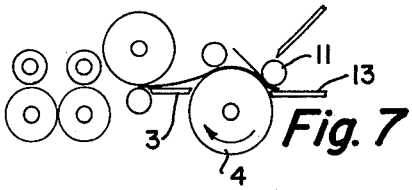
Fig. 7
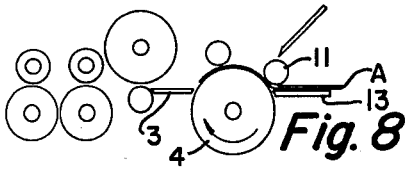
Fig. 8
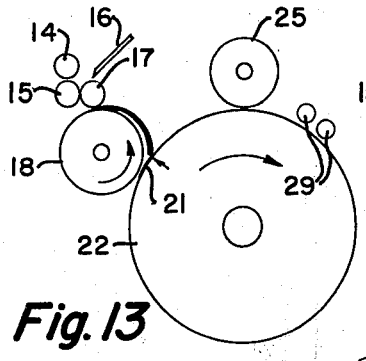
Fig. 13
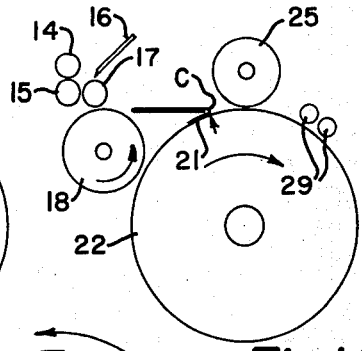
Fig. 14
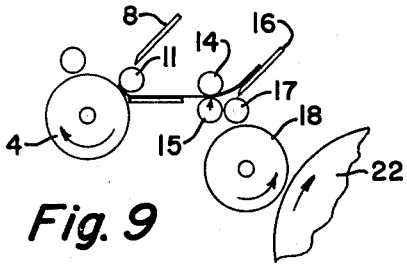
Fig. 9
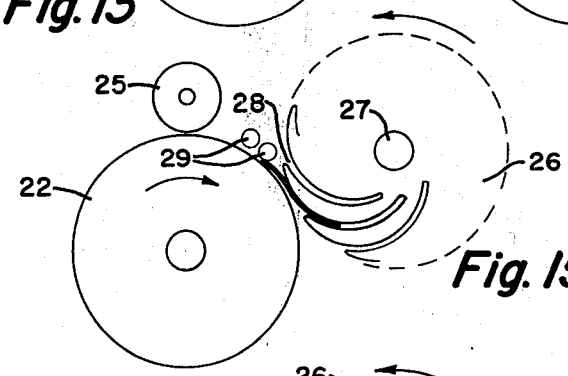
Fig. 15
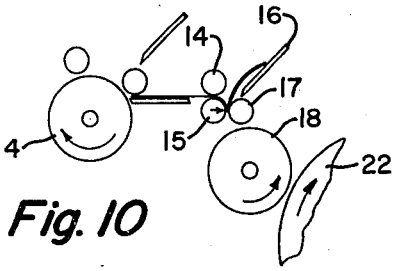
Fig. 10
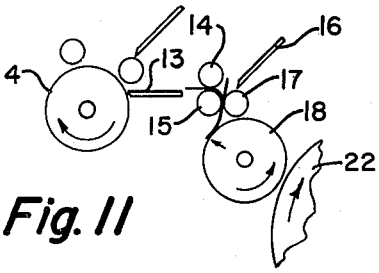
Fig. 11
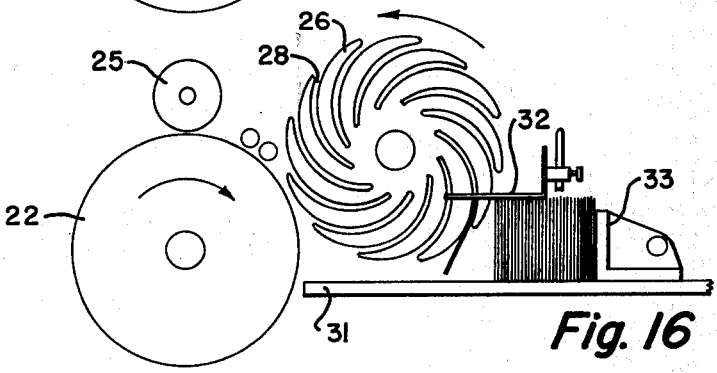
Fig. 16

ENVELOPE MAKING MACHINE

In a known machine for making three-layer envelopes with a closing flap, flat paper blanks are fed through the machine to fold them along two transverse score lines in succession. The folding is accomplished by rolls, between which the blank travels. In such a machine the leading end portion of the traveling blank is folded back over part of the remainder of the blank to form the envelope pocket and then the blank extending rearwardly from the open end of the pocket is folded over the side of the pocket formed from the leading end portion, whereby to cover that side of the pocket. The trailing end of the blank projects a short distance beyond the rest of the envelope to form a closing and sealing flap and is not folded by the machine. In many cases it would be desirable to fold this flap into place over the adjoining portion of the envelope when the envelope is made, rather than leaving that to be done by the user of the envelope, and it is an object of this invention to improve on the known envelope-making machines by providing means for doing that. Other objects are to fold the flap without interrupting the travel of the envelope through the machine and also to do it in an uncomplicated manner.

The preferred embodiment of the invenion is illustrated in the accompanying drawings, in which FIG. 1 is a view of the flat blank for an envelope after side flaps have been folded in and adhesive applied to their upper surfaces;

FIG. 2 shows the blank after the first cross fold has been made, whereby the envelope pocket is formed;

FIG. 3 shows the envelope after the second cross fold has been made;

FIG. 4 shows the finished envelope after the third cross fold has been made;

FIG. 5 is a diagrammatic side view of the envelope-making machine;

FIGS. 6 to 16 are fragmentary diagrammatic side views of the machine showing an envelope blank in different progressive positions as it passes through the machine;

FIG. 17 is an enlarged perspective view of the machine rolls, corresponding to FIG. 6, showing the first fold about to be made;

FIG. 18 is a similar view of the rolls, corresponding to FIG. 11, showing the second fold being made; and FIG. 19 is a perspective view of the rolls, corresponding to FIG. 13, showing the third fold about to be made.

Referring to the drawings, FIG. 1 illustrates diagrammatically a side view of a conventional envelope-making machine provided with my improvement for folding the closing and sealing flap of a special return-mail envelope. The different steps in the making of an envelope as shown in FIGS. 6 to 12 are old, but are necessarily illustrated for an understanding of the operation of the machine and the improvements afforded by this invention. A flat paper blank 1, provided with three longitudinally spaced score lines A, B and C extending across it as shown in FIG. 1, is fed forward between driven rolls 2 in FIG. 5 and across a platen 3 to a driven roll 4 that carries the leading end of the blank forward between that roll and a smaller circumferentially grooved roll 5 above it. If the envelope is the type that is to have side flaps closing the ends of the envelope pocket, these flaps 6 (FIG. 1) are folded in and adhesive is applied to their upper surfaces in conventional manner (not shown) before the blank reaches the part of the machine illustrated. Dots or spots of pressure-sensitive adhesive are applied to the upper surface of the blank behind score line C.

From rolls 4 and 5 the blank travels forward until it strikes an inclined plate 8, by which it is deflected upwardly as it continues to move forward. Roll 4 is provided with a row of vacuum holes 9 in its periphery extending lengthwise of the roll as shown in FIG. 17. The feeding of the blank is timed so that its forward score line A (FIG. 1) will pass the row of vacuum holes just as they leave roll 5, and at that moment a valve in a tube 10, connecting the inside of roll 4 with a vacuum source is opened to reduce the air pressure in the roll so that the blank will be drawn against roll 4 as indicated by the radial arrow in FIG. 6. Then, as the roll continues to rotate, the blank is carried forward and downwardly between it and a smaller roll 11 as shown in FIG. 7, whereby the blank is folded at score line A and creased as the leading end of the blank is pulled back down the deflecting plate 8. This operation, of course, presses the upper layer down against side flaps 6, to which it then adheres to form the envelope pocket. Roll 11 is provided with a pair of circumferential grooves 12 which, like the central grooves in roll 5, also in some of the following rolls, allow the adhesive spots on the trailing end of the blank to pass without engaging the roll.

The folded leading edge of the blank then is released from roll 4 by shutting off the vacuum and admitting air at atmospheric pressure to the inside of the roll, and the folded leading edge strikes a horizontal plate 13 that directs it forward as shown in FIG. 8 and between two small rolls 14 and 15 shown in FIG. 9. From these two rolls the envelope strikes a second inclined plate 16, by which the blank is deflected upwardly again. As soon as the two layers of the envelope have passed rolls 14 and 15, vacuum is applied to a row of holes indicated by the radial arrow in FIG. 9 in the lower roll 15 directly in front of score line B, whereby to pull the blank against it so that the roll will carry the blank downwardly as shown in FIG. 10 between that roll and an idle roll 17 directly in front of it to form a second fold at score line B. The second fold engages a larger lower vacuum roll 18 rotating in a direction opposite from roll 15.

As shown in FIG. 18, roll 18 is provided with a line of vacuum holes 19 and a vacuum hose 20 through which air is drawn, when a valve is opened, to pull the folded leading edge of the envelope against the roll as shown in FIGS. 11 and 18. This roll carries the envelope down and forward beneath the roll. The side of the envelope remote from this roll, which is the outer or third layer of the envelope, extends rearwardly behind the other two layers to form a closing flap 21 as shown in FIG. 12. In the known machines, unlike with this invention, the folded envelope would now be released from the equivalent of roll 18 and carried away for stacking.

It is a feature of this invention that the envelope is provided with a third fold at score line C before it is stacked. This fold causes flap 21 to overlie the adjoining portion of the envelope. Accordingly, the twice folded blank shown in FIGS. 3 and 12 is carried by roll 18 upwardly between it and a driven roll 22. These two rolls are referred to in the claims hereof as the first roll and the second roll. As the flap 21 reaches roll 22, the outer surface of the flap is drawn against that roll as indicated in FIG. 13 by means of a line of vacuum holes 23 extending lengthwise of the roll as shown in FIG. 19. The inner ends of these holes are in communication with a vacuum hose 24 attached to one end of the roll. Roll 22 carries the flap upwardly and away from roll 18 as shown in FIG. 14, and in the process flap 21 is folded up under the adjoining portion of the envelope along score line C and the envelope is pulled away from roll 18 in which atmospheric pressure has been restored. The completely folded envelope now is carried forward beneath a roll 25 that creases the third fold C and sticks flap 21 against the overlying layer of the envelope.

As the envelope leaves this last roll, atmospheric pressure is restored in roll 22 and the envelope is stripped from roll 22 and stacked on edge. The stripper is made up of a drum or a series of vertical circular plates 26 rigidly mounted along a driven horizontal shaft 27 that rotates in a direction opposite to the rotation of roll 22. The plates are provided with circumferentially spaced slots 28 that extend inwardly from the edges of the plates in an arc toward the central shaft. As shown in FIG. 15, the leading edge of the envelope on roll 22 enters one set of these arcuate slots and, as the roll carries the envelope downwardly, the envelope is pushed into the slots with the help of a pair of rolls 29 cooperating with roll 22 near the stripper. As the stripper continues to rotate, the trailing edge of the envelope is carried down into engagement with the top of a platen 31 and is dragged along it until the leading edge or top of the envelope engages the bottom of a vertically adjustable stop plate 32. This plate prevents the stripper from carrying the envelope any further upwardly. The released envelope is held more or less upright by engagement with a back stop 33, if it is the first envelope, or by engagement with a row of previously released upright envelopes between it and the back stop. As the stripper deposits successive envelopes on the platen, the back stop is moved forward along the platen in a known manner to accommodate the constantly increasing length of the stack of envelopes on the platen.

According to the provisions of the patent statutes, I have explained the principle of my invention and have illustrated and described what I now consider to represent its best embodiment. However, I desire to have it understood that, within the scope of the appended claims, the invention may be practiced otherwise than as specifically illustrated and described.

I claim:

1. In a machine for making three-layer envelopes from paper blanks, a first rotating roll provided in its periphery with a row of vacuum holes extending lengthwise thereof, means for reducing the air pressure in said holes to hold against the roll the previously folded leading edge of a twice folded traveling envelope having an unfolded closing flap at the trailing edge of the side of the envelope remote from the roll, a second roll beside the first roll and rotating in the opposite direction, the second roll being provided in its periphery with a row of vacuum holes extending lengthwise thereof, means for reducing the air pressure in said last-mentioned holes to hold the outer surface of said flap against the second roll as the first roll carries the envelope between the two rolls, atmospheric pressure being restored to said holes in the first roll to release the envelope therefrom when said flap becomes held by the second roll so that the flap will be folded behind the adjoining portion of the envelope as the second roll pulls the envelope away from the first roll, means for then pressing the envelope against the second roll to crease the fold at said flap, the side of said flap that faces said first roll while the envelope is held against the first roll being provided with spots of pressure-sensitive adhesive, whereby said pressing means will stick said flap to the envelope surface overlapped by the flap, and means for removing the closed envelope from the second roll.

2. In a machine for making three-layer envelopes from paper blanks, first roll means for folding the leading end portion of a forwardly traveling paper envelope blank back over less than half of the remainder of the blank to form two layers, second roll means for then folding said two layers back only part way over said remainder of the blank to form a third layer with an unfolded envelope-closing flap at its trailing edge, a first rotating roll provided in its periphery with a row of vacuum holes extending lengthwise thereof, means for reducing the air pressure in said holes to hold against said first roll the previously folded leading edge of the twice folded traveling envelope delivered to said first roll by said second roll means with said third layer spaced from said first roll by the other two layers, a second roll beside the first roll and rotating in the opposite direction, the second roll being provided in its periphery with a row of vacuum holes extending lengthwise thereof, means for reducing the air pressure in said last-mentioned holes to hold the outer surface of said flap against the second roll as the first roll carries the envelope between the first and second rolls, atmospheric pressure being restored to said holes in the first roll to release the envelope therefrom when said flap becomes held by the second roll so that the flap will be folded behind the adjoining portion of the envelope as the second roll pulls the envelope away from the first roll, means for then pressing the envelope against the second roll to crease the fold at said flap, and means for removing the closed envelope from the second roll.

3. In a machine as recited in claim 2, said second roll means including a pair of rotating rolls for receiving between them from said first roll means a mid portion of the two-layer blank to form said third layer and then deliver the twice folded envelope edgewise to said first roll.

* * * * *